US007737398B2

(12) United States Patent
Michelmann

(10) Patent No.: US 7,737,398 B2
(45) Date of Patent: Jun. 15, 2010

(54) LINEAR RF ION TRAP WITH HIGH MASS RESOLUTION

(75) Inventor: Karsten Michelmann, Bremen (DE)

(73) Assignee: Bruker Daltonik GmbH, Bremen (DE)

( * ) Notice: Subject to any disclaimer, the term of this patent is extended or adjusted under 35 U.S.C. 154(b) by 298 days.

(21) Appl. No.: 11/955,581

(22) Filed: Dec. 13, 2007

(65) Prior Publication Data

US 2008/0142706 A1 Jun. 19, 2008

(30) Foreign Application Priority Data

Dec. 18, 2006 (DE) ..... 10 2006 059 697

(51) Int. Cl.
*H01J 49/42* (2006.01)
*H01J 49/00* (2006.01)

(52) U.S. Cl. ..... 250/292; 250/282; 250/281

(58) Field of Classification Search ..... 250/292, 250/282, 281
See application file for complete search history.

(56) References Cited

U.S. PATENT DOCUMENTS 5,420,425 A 5/1995 Bier et al. ..... 250/292
5,693,941 A 12/1997 Barlow et al.
5,712,480 A 1/1998 Mason
6,177,668 B1 * 1/2001 Hager ..... 250/282
6,797,950 B2 9/2004 Schwartz et al.
6,831,275 B2 * 12/2004 Franzen et al. ..... 250/292
6,844,547 B2 1/2005 Syka ..... 250/292
6,870,156 B2 3/2005 Rather
7,196,327 B2 3/2007 Thomson et al. ..... 250/292
7,456,398 B2 * 11/2008 Senko et al. ..... 250/292
2005/0056778 A1 3/2005 Thomson et al.
2008/0067362 A1 3/2008 Senko ..... 250/292
2008/0073497 A1 3/2008 Kovtoun ..... 250/282

* cited by examiner

*Primary Examiner*—Nikita Wells
(74) *Attorney, Agent, or Firm*—O'Shea Getz P.C.

(57) ABSTRACT

In a linear ion trap in which an essentially quadrupole RF electrical field is generated between at least four rod-shaped electrodes, ions may be mass-selectively ejected orthogonally to the axis. An aspect of the invention comprises compensating for field irregularities along the axis of a linear ion trap, which result, at different ejection locations, in the ejection of ions of the same masses at slightly different times, by of measuring the ions that are ejected at the different ejection locations using a number of separate detectors, and correcting, after a mass calibration of each of the mass spectra, the time shifts of the various location-dependent mass spectra during their addition to a combined spectrum.

22 Claims, 2 Drawing Sheets

LINEAR RF ION TRAP WITH HIGH MASS RESOLUTION

PRIORITY INFORMATION

This patent application claims priority from German patent application 10 2006 059 697.8 filed Dec. 18, 2006, which is hereby incorporated by reference.

FIELD OF THE INVENTION

The invention relates to a linear ion trap in which an essentially quadrupolar RF electrical field is generated between at least four rod-shaped electrodes, and which can mass-selectively eject ions orthogonally to the longitudinal axis of the ion trap.

BACKGROUND OF THE INVENTION

Linear ion traps are described in U.S. Pat. No. 5,420,425 to Bier et al. A particularly preferred embodiment, which is in fact applied in a successful commercial mass spectrometer, consists in assembling four hyperbolically shaped rods to create a very precise linear quadrupole system, making slots in two opposing rods, and mass-selectively ejecting the gas-cooled ions through the slots by radial resonant excitation. If the arrangement is perfectly symmetrical, the ions then emerge, during what is called a mass scan, uniformly (although in offset ion pulses, on account of the resonantly excited vibrations of the ion cloud) through the two slots in the opposing pole rods throughout the individual ion mass signals, and are measured by two flat detectors placed in front of the two slots. An ion trap of this type is shown schematically in FIG. 1, although only one of the detectors is visible.

In order to record a mass spectrum, a mass scan is required in which the operating parameters of the ion trap are changed in such a way that ions are ejected mass-selectively and mass-sequentially out of the ion trap and into the detectors where they are measured. "Mass" refers here, as is always the case in mass spectrometry, to the mass-to-charge ratio, m/z. The specialist knows several types of such mass scans, including, in particular, ejection by storage instability at the edge of the Mathieu stability diagram, and ejection of the ions by radial, resonant excitation by a dipolar RF excitation voltage. In the latter case, the resonant ejection can be supported by nonlinear resonances; this then permits particularly fast scan methods with high mass resolution, as described in U.S. Pat. No. 6,831,275. Ejection by nonlinear resonances also offers the advantage that the ions can be ejected on one side only, so that only one detector is required.

An advantage of linear ion traps over so-called three-dimensional ion traps, which consist of a ring electrode and two end cap electrodes, is that they are easier to fill and have a high capacity for ions. A disadvantage of this arrangement is the extraordinarily high precision necessary to give a constant form and intensity to the RF electrical field at every cross-section along the axis. The precision of the RF field is affected by disturbing effects at both ends of the pole rod system, disturbances at the ends of the slots, and, in particular, by the mechanical precision required for the shape and spacing of the pole rods.

Pole rods are usually used with an internal spacing of eight millimeters, that is to say an "inside radius" of four millimeters. If, at any point along the axis, this radius deviates from its specified value by as little as two micrometers, then ions with a mass of 2001 Daltons (or 1999 Daltons) are ejected instead of the desired 2000 Daltons. If ions with a mass of 1000 Daltons are to be ejected, then ions with a mass of 1000.5 Daltons (or 999.5 Daltons) are ejected at the location of the inaccuracy. This means that a mass spectrometer of this type does not offer usable resolution if it has such dimensional inaccuracies. The usable mass range is also limited, as a resolution of a single mass unit is no longer available above 2000 Daltons. In fact the mechanical precision required for the pole rods of a usable mass spectrometer is much less than a micrometer.

The requirement for a mechanical precision of well below one micrometer is, however, almost impossible to meet. Commercial mass spectrometers of this type are restricted to a mass range of 2000 Daltons, with a maximum resolution at the upper end of the mass range of about R equal to 4000, whereas commercial three-dimensional ion traps consisting of turned parts offer a mass range of 3000 Daltons along with a mass resolution of more than R equal to 10,000 at the upper end of the mass range. This difference is crucial for many applications, such as modern protein analysis.

SUMMARY OF THE INVENTION

Ions ejected orthogonally to the axis are measured not by one or two detectors each covering the full length, but instead arranging a number n of detectors along the axis, and measuring n location-specific mass spectra with these detectors. The mass spectra are subjected to mass calibration prior to use to determine the time shifts of the location-specific mass spectra against each other. During use, combining mass spectra into a sum spectrum corrects the mass shifts of the location-specific mass spectra.

It is possible for the n detectors to be located on two opposing sides of the arrangement of pole rods, or only on one side. With two opposing rows of detectors, usual resonance ejection may be performed, using an applied exciting field. The resonant ejection may be enhanced in a well-known manner by generating so-called nonlinear resonance phenomena inside the ion trap. The nonlinear resonance phenomena may be generated by shaping or displacing the pole rods of the linear ion trap, thus superimposing the multipole field on the basic quadrupole field. In the case of one row of detectors only, it is favorable to superimpose hexapole and octopole components on the quadrupole RF field so that the ions are ejected on one side only. If the ejection is supported by nonlinear resonances, then, as already noted above, particularly fast scan methods for a given mass resolution are possible.

The n detectors may include relatively simple Faraday collectors, or may comprise secondary electron multipliers (SEM). A multichannel plate (MCP) that amplifies single secondary electrons, but has n individual electron collectors for location-specific measurement of the emerging electron avalanches, may be particularly suitable.

The individual ion currents from the n detectors may be amplified in parallel by operational amplifiers and digitized in parallel in analog-to-digital converters to generate n sequences of values, each of which represents a location-specific mass spectrum. The sequences of values may then be added together, one value at a time, with time offsets considering the time shifts observed by calibration, to generate a sequence of cumulative values from which the desired mass spectrum can be obtained; the offset only has to be calibrated once in each case. The time shifts are proportional to the ion masses in most cases.

These and other objects, features and advantages of the present invention will become more apparent in light of the following detailed description of preferred embodiments thereof, as illustrated in the accompanying drawings.

DETAILED DESCRIPTION

Figure 1:
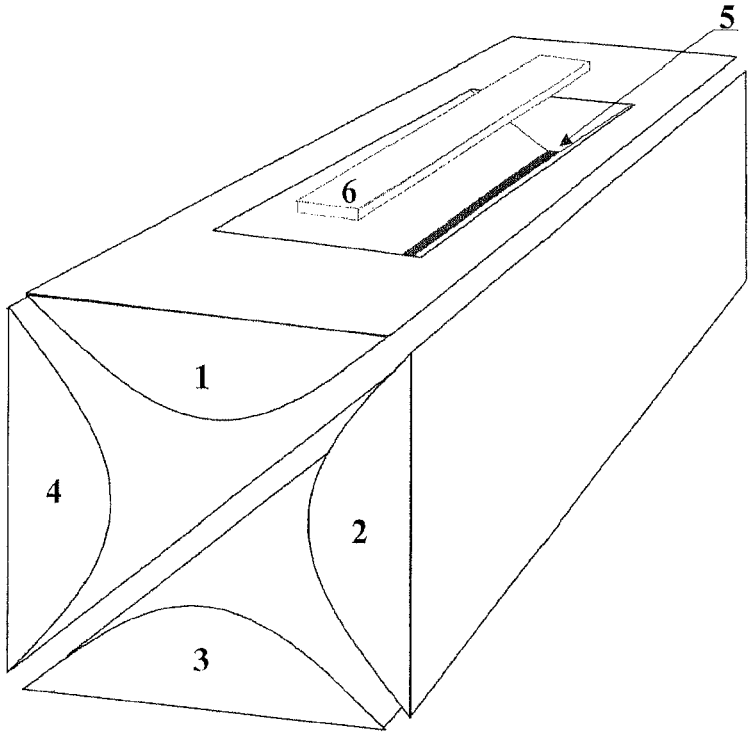
FIG. 1 illustrates a basic arrangement of a prior art linear ion trap, having four hyperbolic pole rods 1, 2, 3, 4. The first pole rod 1 has a slot 5, and a detector 6 that extends over the full length of the slot and measures the ions ejected from the slot 5. A second detector (not shown) may be positioned underneath the pole rod 3.
Figure 2:
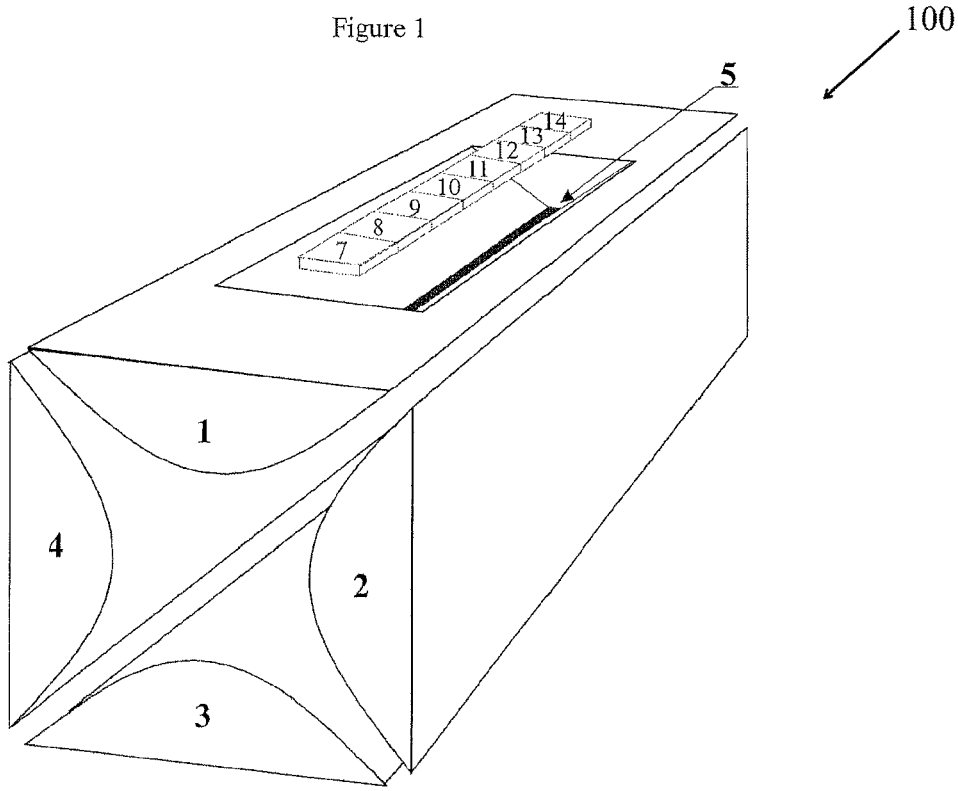
FIG. 2 illustrates a basic arrangement of a linear ion trap 100 according to an aspect of the present invention, in which a row of individual detectors, for example 7-14 is positioned in front of the slot 5, allowing individual location-specific ion currents to be measured along the length of the slot.
Figure 3:
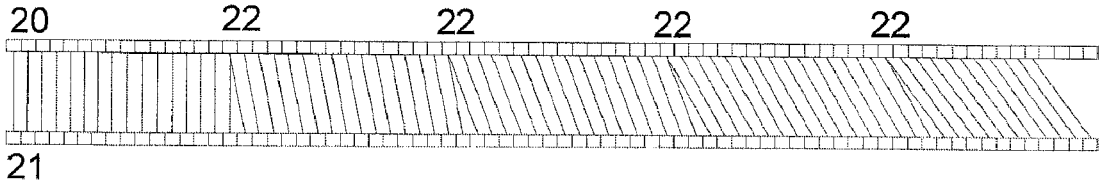
FIG. 3 shows, schematically, the addition of a sequence of mass spectrum values 20 into a target sequence of values 21 with an offset, proportional to time shift. In this case the mass spectrum 20 is extended, the values 22 each being used twice.
Figure 4:
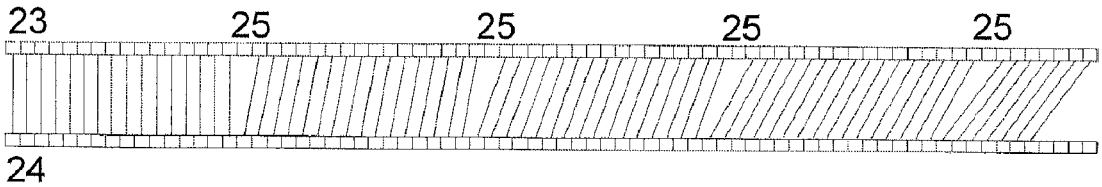
FIG. 4 shows, schematically, the addition of a sequence of values 23 into a target sequence of values 24, where the mass spectrum represented by the sequence of values 23 is compressed, the values 25 being omitted.

A linear ion trap 100 includes two multichannel plates that multiply secondary electrons which are each covered by a row of eight electron traps, as can be seen in FIG. 2. A mass scan involves mass-selective and mass-sequential ejection of ions, for which a variety of ejection methods known to the person skilled in the art may be applied. Each electron collector is connected to an operational amplifier that further amplifies the flow of ions from a small region along the axis of the pole rod system, and feeds the current on to an analog-to-digital converter (ADC). A plurality of (e.g., sixteen) digital location-specific mass spectra, each of which includes a long series of digital ion current values, may then be added together, one value at a time, applying an offset proportional to the mass, to each series of values in such a way that corresponding mass signals are added together to yield optimum mass resolution of the combined series of values representing the total mass spectrum. The optimum mass-proportional offset must be determined once on the basis of calibration spectra. An arrangement for such an addition, with a mass-proportional offset, of the values from a mass spectrum value store 20 into a destination store 21, for which the mass spectrum is stretched by using certain measurements 22 twice, is illustrated in FIG. 3. FIG. 4 illustrates an addition process where the mass spectrum 23 is compressed, certain measurements 25 not being used.

The mass-proportional offset applied when adding the individual series of mass spectrum values means that the spectra from regions where the pole rods have a slightly different radius are matched to the other spectra, as a result of which the total mass spectrum has a better mass resolution. This method may also eliminate other kinds of disturbance, such as the influences of the end electrodes of the pole rod system, or the influences of the ends of the slits on the RF field.

It is even more favorable to superimpose hexapole and octopole fields on the quadrupole field so that, by choosing the correct excitation frequency and phase, the resulting ion ejection is greatly enhanced by nonlinear resonance phenomena and the ions are only ejected from one side of the pole rod system. Advantageously, multichannel plates, with a total of sixteen electron collectors, are then no longer necessary; the same mass resolution may be attained with just one multichannel plate and eight electron collectors. At the same time, the number of operational amplifiers and ADCs is also reduced. Supporting the ejection of ions by nonlinear resonances accelerates and sharpens the ejection, with the result that the mass resolution is improved at the same scan speed. If a hexapole field is superimposed, a strong nonlinear resonance occurs at one third of the high frequency. This can preferably be used by also selecting this frequency for the dipolar RF excitation frequency, and carrying out the mass scan by continuously raising the RF voltage at the pole rods.

A linear ion trap of this type is usually operated with a frequency for the RF voltage of about 1 megahertz. Resonant ejection supported by nonlinear resonance then occurs at about 333 kilohertz. It is therefore possible, in a fast scan, to sample the ejected ion packages synchronously at 333 kilohertz in such a way that for each unit of mass/charge (unified atomic mass unit, u, or Dalton, Da) the ion current is sampled precisely eight times. By using eight electron collectors and adding the spectra, taking into account the offset proportional to mass, the maximum deviation of the mass spectra from one another is reduced to ⅛ of one mass unit; this easily permits two ion current signals to be separated for one mass unit. This means that doubly charged ions can also be measured with good mass resolution. The upper limit of the useful mass range is therefore extended. With this kind of ion current detection it is possible to achieve a mass range of up to 3000 Daltons and more. A full, fast mass scan up to a mass of 3000 Daltons takes only about 80 milliseconds.

Figure 5:
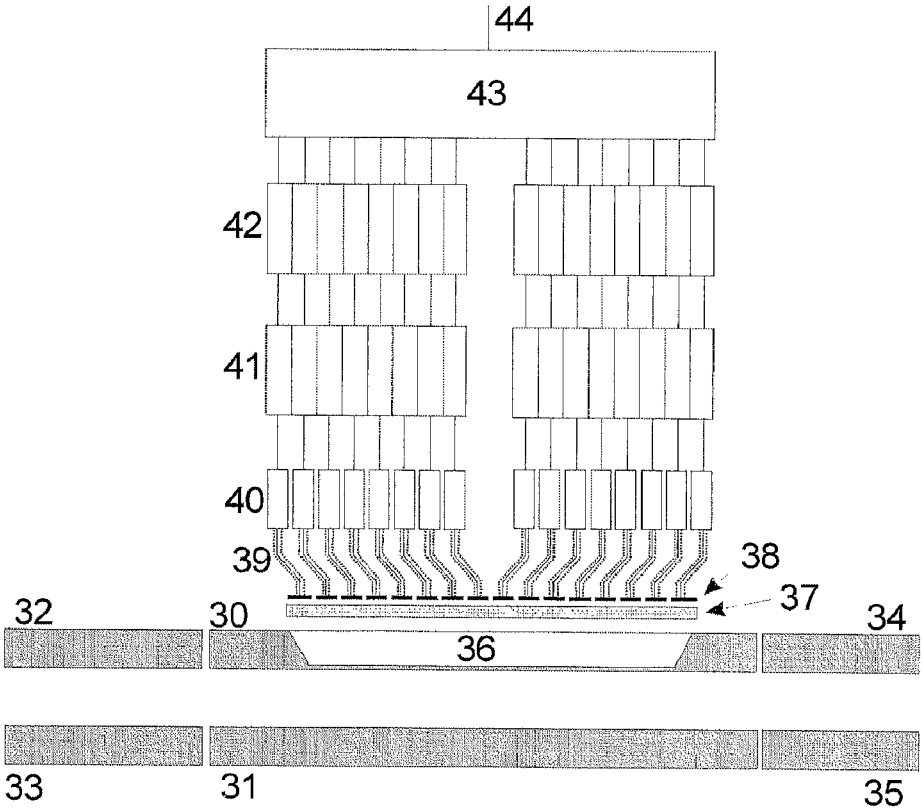
FIG. 5 illustrates, schematically, a linear ion trap with pole rods 30 and 31, a prefilter with pole rods 32 and 33, and an postfilter with pole rods 34 and 35. The purpose of the prefilter and postfilter is to improve the field distribution inside the linear ion trap in the known manner. The pole rod 30 has a cutout 36 for the slit. In front of the pole rod 30 there is a multichannel plate 37 to amplify secondary electrons. The electron avalanches emerging from the multichannel plate 37 are collected in this embodiment by sixteen electron collectors 38, and fed via coaxial cables 39 for amplification in operational amplifiers 40 and for digitization 41. The digitized values are stored temporarily in first-in-first-out registers (FIFOs) 42, to permit the respective offset. They are then added together in a computing unit 43, for instance an FPGA or a signal processor, with the inclusion of the mass-proportional offset, and fed via line 44 to a computer for further processing.

In the case of a slower mass scan, such as is used, for instance, when measuring peptides, 16 samples per mass unit can be set. Even then, a full mass scan up to a mass of 3000 Daltons takes only about 160 milliseconds. With a view to a higher mass resolution, it is favorable for example to use sixteen electron collectors instead of just eight along the axis of the pole rod system, as shown in FIG. 5. With a moderately precise pole rod system, and appropriately calibrated, offset addition proportional to mass, a mass resolution of four ion signals (peaks) per mass unit can be achieved. This makes it possible to recognize the isotope groups of ions with four charges. By using sixteen electron collectors 38, sixteen operational amplifiers 40 and sixteen analog-to-digital converters 41 it is possible, instead of the ADC with a width of sixteen bits that is usually used, to use sixteen ADCs, each with a width of only 12-bits. For a higher dynamic measuring range, it is even more favorable to use sixteen ADCs with a width of 14-bits. These deliver a spectrum that corresponds to the spectrum from an ADC with a width of 18-bits. This permits the true intensity of the mass spectra obtained when the linear ion trap is filled with 100,000 ions to be measured. 14-bit ADCs are available nowadays for less than 10 U.S. dollars; inexpensive combinations of eight 14-bit ADCs in a single component 41 can also be obtained, as shown schematically in FIG. 5. All the electronic devices, including sixteen operational amplifiers, sixteen ADCs, the addressing devices and the appropriate memory for the digital values can nowadays easily be housed on a relatively small electronic circuit board, and manufactured economically.

The addition, including the mass-dependent offset, can be carried out on a connected PC. With a mass range of 3000 Daltons, and with sixteen values, each 16-bits wide, per mass unit, a single mass spectrum requires only 96 kilobytes. However, a bottleneck can easily occur here if immediate feedback is required from one mass spectrum in order to control a subsequent mass spectrum, such as when a daughter ion spectrum from a particular ion species is to be measured. In such cases it is possible for one of the 16 mass spectra to be transferred to the PC in real time, and for this spectrum to be analyzed to obtain feedback. Although this spectrum does have a poorer signal-to-noise ratio, it is otherwise of the same quality as the sum spectrum.

A better electronic version of the linear ion trap mass spectrometer uses a computing unit 43 for adding the sixteen individual spectra with their mass-proportional offset. The computing unit 43 may be mounted on the same circuit board, and can transmit the sum spectrum to the PC via a bus 44 almost in real-time, except for a small latency required for the offset. This permits feedback control based on analysis of the sum spectra. The computing unit 43 may include, for example, a field programmable gate array (FPGA); a fast signal processor may also be used for the addition. It is favorable to insert first-in-first-out (FIFO) registers 42 in between, so that the appropriate offset value is available for the offset addition. The FIFOs are filled about half full before beginning the addition. Their filled cells or their empty cells can provide the buffering necessary for the offset addition. FIFOs that are each able to buffer about 32 measurement values are favorable. This allows an offset of 16 measurements, that is to say one complete mass unit up or down, to be captured, meaning that deviations in the precision of the parallel alignment of the pole rods of plus/minus eight micrometers can be tolerated. An inaccuracy of eight micrometers should nevertheless be avoided, as it is then no longer possible to compensate for other impairments of the mass resolution.

It is not, however, necessary to use eight or 16 analog-to-digital converters. The individually amplified analog ion currents can also be delayed with respect to one another by mass-proportionally adjustable delay elements in such a way that a high resolution is again obtained. The mass-proportional delays are only adjusted relative to one another a single time, preferably at the factory. The analog ion currents, with their trimmed delays, are then subjected to analog addition and fed to the analog-to-digital converter.

The individual electron collectors above the multichannel plate do not all have to be the same size. A different distribution may be more favorable, for instance to provide finer compensation for disturbances at the ends of the slots of the pole rod system by using narrower collectors.

A range extending up to high masses together with good mass resolution is particularly valuable to the biological sciences, as there is a trend toward the analysis of larger and larger biomolecules, which in many cases are not fragmented until they reach the mass spectrometer. The great majority of modern ion trap mass spectrometers are equipped with electrospray ion sources, which generate multiply charged ions of the larger biomolecules. For this reason it is advantageous if the mass analyzer can resolve not just the isotope groups of doubly charged ions, but also those of biomolecules with three and four charges. If deprotonation methods are used to reduce the number z of charges, it follows that a high mass range will be required, as the mass-to-charge ratio m/z measured in the mass spectrometer becomes very large.

Instead of a measuring setup employing one or two multichannel plates over the whole length together with divided electron collectors, it is also possible to use a large number of other types of measuring setup, such as Faraday collectors, individual dynode multipliers, individual Channeltron multipliers, or individual multichannel plate multipliers.

The specialist in this field, with the knowledge of this invention, can easily develop further technical adaptations to a linear ion trap for various analytical tasks. In addition, one of ordinary skill in the art will recognize that the present invention is not limited to 8 or 16 detectors discussed herein.

Although the present invention has been illustrated and described with respect to several preferred embodiments thereof, various changes, omissions and additions to the form and detail thereof, may be made therein, without departing from the spirit and scope of the invention.

What is claimed is:

1. A linear ion trap for a mass spectrometer, with radial ejection of the ions, comprising:

n ion detectors for measuring the currents of the ejected ions, with n greater than one, and the n ion detectors are located at an exterior side and along a longitudinal axis of the linear ion trap, wherein each ion detector provides a location-specific ion signal.

2. The linear ion trap of claim 1, wherein the n ion detectors are followed by n amplifiers and n analog-to-digital converters, which generate n series of values from the currents in the n ion detectors; the n series of values represent n location-specific mass spectra.

3. The linear ion trap of claim 2, wherein a computing unit is incorporated, in which at least some of the n series of values are added value by value, with offsets considering time shifts between the location-specific mass spectra as measured by prior calibration, to form a cumulative series of values representing the total mass spectrum.

4. The linear ion trap of claim 3, wherein the computing unit incorporates a memory for calibration constants, with which the time offsets are controlled during addition.

5. The linear ion trap of claim 3, wherein a PC, an FPGA or a signal processor is used as the computing unit that adds the series of values to create the cumulative series of values.

6. The linear ion trap of claim 5, wherein a FIFO register is present for each series of values, and is used to buffer the values for the addition with offsets.

7. The linear ion trap of claim 1, wherein the n ion detectors comprise a multichannel plate with n electron collectors collecting the electrons emerging from the multichannel plate.

8. The linear ion trap of claim 1, comprising electronic means for generating an exciting field inside the linear ion trap to resonantly eject the ions.

9. The linear ion trap of claim 8, comprising at least four pole rods, the pole rods being shaped or displaced to superimpose multipole fields on an essentially quadrupolar field inside the ion trap, thus generating nonlinear resonance phenomena inside the ion trap.

10. The linear ion trap of claim 9, wherein the frequency of the exciting field is chosen such that the resonant ejection of ions is enhanced by one of the nonlinear resonances.

11. The linear ion trap of claim 10, wherein, by a mixture of higher multipole fields superimposed on the quadrupole field, the radial ejection of ions is directed to one side only, and wherein the ion detectors are arranged at one side of the ion trap only.

12. The linear ion trap of claim 11, wherein the mixture of multipole fields superimposed on the quadrupole field essentially comprise a hexapole and an octopole field.

13. The linear ion trap of claim 1, wherein adjustable delay lines are incorporated, in which the analog currents from the n ion detectors can be given an adjustable mass-proportional delay, before they are added and digitized.

14. A linear ion trap, comprising:

a quadrupole ion trap that includes four pole rods that form a chamber for containing ions, where a first of the four pole rods includes a through slit from an interior side of the first of the four rods to an exterior side of the first of four pole rods, such that ions may pass from the interior side through the slit to the exterior side; and a plurality of ion detectors located lengthwise adjacent to the slit on the exterior side of the first rod, where each ion detector provides a uniquely associated detected ion signal.

15. The linear ion trap of claim 14, where the plurality of ion detectors are configured and arranged in a straight line parallel to a longitudinal axis of the slit.

16. The linear ion trap of claim 15, where the plurality of ion detectors includes at least eight detectors.

17. The linear ion trap of claim 15, where the width of the slit decreases from the exterior surface to the interior surface.

18. The linear ion trap of claim 17, where a multichannel plate is located between the slit and the plurality of detectors.

19. The linear ion trap of claim 18, comprising a plurality of analog-to-digital converters that each receives a uniquely associated one of the detected ion signals.

20. A linear RF ion trap, comprising:

an ion trap that includes four pole rods that form a chamber for containing ions, where a first of the four pole rods includes a lengthwise through slit from an interior side of the first of the four rods to an exterior side of the first of four pole rods, such that ions may pass from the interior side through the slit to the exterior side;

a plurality of ion detectors located lengthwise adjacent to the slit on the exterior side of the first rod, where each ion detector provides a uniquely associated detected ion signal; and a controller that adds the detected ion signals with offsets considering time shifts between the location-specific mass spectra as measured by prior calibration, to form a cumulative series of values representing the total mass spectrum.

21. A method of measuring a mass spectrum with a linear ion trap having a longitudinal axis, comprising: injecting ions into the linear ion trap; trapping injected ions in the linear ion trap; mass selectively ejecting the ions from the linear ion trap in a radial direction with respect to the longitudinal axis; measuring location-specific mass spectra with a plurality of ion detectors; and combining the location-specific mass spectra data provided by the plurality of detectors into a sum spectrum by correcting mass shifts of the location specific mass spectra.

22. The method of claim 21, where the measuring location-specific mass spectra with a plurality of ion detectors comprises measuring the location-specific mass spectra along a first exterior side of the linear ion trap and measuring the location-specific mass spectra along a second exterior side of the linear ion trap.

* * * * *